US007744375B2

(12) United States Patent
Huang et al.

(10) Patent No.: US 7,744,375 B2
(45) Date of Patent: Jun. 29, 2010

(54) SIGNAL TRANSMISSION DEVICE FOR TOWING VEHICLE

(75) Inventors: Shiao-Hwa Huang, Taichung (TW); Ming-Kuan Liao, Hsinchu County (TW); Yu-Chang Tsai, Taichung Hsien (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 61 days.

(21) Appl. No.: 12/175,031

(22) Filed: Jul. 17, 2008

(65) Prior Publication Data

US 2009/0170347 A1 Jul. 2, 2009

(30) Foreign Application Priority Data

Jan. 2, 2008 (TW) ..... 97100112 A

(51) Int. Cl.
*H01R 33/00* (2006.01)

(52) U.S. Cl. ..... 439/35

(58) Field of Classification Search ..... 439/35, 439/38–40, 289, 142
See application file for complete search history.

(56) References Cited

U.S. PATENT DOCUMENTS 5,739,592 A * 4/1998 Rigsby et al. ..... 307/9.1
5,954,520 A * 9/1999 Schmidt ..... 439/39
6,558,167 B2 * 5/2003 Harmon et al. ..... 439/35
6,608,554 B2 * 8/2003 Lesesky et al. ..... 340/431
6,799,814 B2 * 10/2004 Lesesky et al. ..... 303/122.02
7,172,150 B1 2/2007 Hutchison, II et al.
7,258,559 B2 8/2007 Mattern et al.
7,435,093 B1 * 10/2008 Harmon et al. ..... 439/35
7,497,529 B2 * 3/2009 Lesesky et al. ..... 303/123
7,575,450 B2 * 8/2009 Williams et al. ..... 439/144
2007/0072461 A1 3/2007 Williams et al.

FOREIGN PATENT DOCUMENTS

TW 478457 3/2002
TW M246643 10/2004

* cited by examiner

*Primary Examiner*—Jean F Duverne
(74) *Attorney, Agent, or Firm*—Browdy and Neimark, PLLC

(57) ABSTRACT

A signal transmission device is used for connection between a first electrical connector at a truck-tractor of a towing vehicle and a second electrical connector at a trailer of the towing vehicle. The signal transmission device includes first and second magnetic holders, third and fourth electrical connectors mounted to the first and second magnetic holders respectively, a stretchable coil tube, and a cable. The first magnetic holder is adapted to be attached to the truck-tractor and the second magnetic holder is adapted to be attached to the trailer. The third electrical connector is adapted for connecting the first electrical connector at the truck-tractor and the fourth electrical connector is adapted for connecting the second electrical connector at the trailer. The cable is spirally inserted through the stretchable coil tube and provided with two ends electrically connected with the third and fourth electrical connectors.

14 Claims, 4 Drawing Sheets

SIGNAL TRANSMISSION DEVICE FOR TOWING VEHICLE

BACKGROUND OF THE INVENTION

1. Field of the Invention

The present invention relates to a signal transmission device for a towing vehicle and more particularly, to a signal transmission device, which utilizes a magnetic attractive force to fasten the electrical connectors at the two ends of a cable to the truck-tractor and trail of towing vehicle respectively and, which allows quick mounting and dismounting of the electrical connectors.

2. Description of the Related Art

A towing vehicle uses a truck-tractor to pull a trailer, semi-trailer, platform or container platform. The cart (trailer, semi-trailer, platform or container platform) to be pulled is provided at the rear side of the truck-tractor and linked thereto by a coupling. The coupling is a mechanical linking mechanism that allows the truck-tractor to pull the card and to turn the card when the truck-tractor is turning, shortening the turn radius of the towing vehicle. The coupling simply provides a mechanical link, cannot transmit electric signals.

Subject to traffic regulations for safety parts, the cart to be pulled by a truck-tractor must be equipped with directional lights, stoplights, and parking lights. These signal lights must be controlled by the truck-tractor so that the driver in the truck-tractor can operate related switches to turn on/off these signal lights. Therefore, a cable must be arranged between the truck-tractor and the cart linked to the track-tractor for transmission of electric signals.

Further, an advanced truck-tractor may be installed therein a monitoring system to monitor the operation status of the cart being pulled. The status signals and data generated by this monitoring system must be transmitted to the truck-tractor. For example, a TMPS (Tire Pressure Monitoring System) has sensors installed in the wheels of the towing vehicle to detect the tire pressure of the wheels and to transmit the respective detected tire pressure signal by radio. However, because of low power level, the radio signal must be filtered and amplified by a receiver circuit in the cart that is pulled by the truck-tractor and then transmitted by the receiver circuit through a cable to the console in the truck-tractor.

Therefore, a cable must be provided between the truck-tractor and the cart being pulled by the truck-tractor to achieve signal transmission. However, the connection between the truck-tractor and the cart must be easily detachable so that another cart can be switchingly connected to the truck-tractor. For example, when the truck-tract of a container truck pulled the container with the container platform from the start point to the destination, the container platform must be immediately disconnected from the truck-tractor so that an empty container platform can be connected to the truck-tractor and then pulled by the truck-tractor to the start point again for exchange of the empty container platform with another container platform that carries another container for a next transportation. During connection and disconnection between the truck-tractor and the attached cart, the cable must be relatively connected and disconnected.

For quick connection of a cable between a truck-tractor and a cart to be pulled by the truck-tractor according to a conventional method, an electrical female connector is respectively and fixedly provided at the truck-tractor and the cart to be pulled by the truck-tractor, and the two opposite ends of the cable are respectively provided with an electrical male connector. By means of detachably connecting the electrical male connectors to the electrical female connectors, the cable is quickly and detachably connected between the truck-tractor and the cart. When the truck-tractor changes the moving direction, the distance between the two electrical female connectors is relatively increased, causing the cable to be stretched. To avoid disconnection of the electrical male connectors from the electrical female connectors when the cable is being stretched, means for preventing disconnection may be provided to enhance the connection between the respective electrical male connectors and the respective electrical female connectors. According to conventional methods, a locking device is provided at each electrical female connector for locking the associated electrical male connector. Taiwan Utility Model Nos. 478457 and M246643, U.S. Pat. No. 7,258,559 and publication No. 2007072461 teach the use of different fixation means to lock the electrical male connector, keeping positive connection between the electrical male connector and the matched electrical female connector. Further, U.S. Pat. No. 7,172,150 discloses a retractable reel apparatus for connecting the electrical wiring on a trailer to the electrical system of a towing vehicle. This design allows adjustment of the connection length of the electrical wiring to fit straight movement or turning of the truck-tractor.

However, the use of lock means to lock an electrically female connector to an electrical male connector simply prohibits movement of the electrical male connector in direction away from the electrical female connector. When stretched by an external force (stretched by the cable), the electrical male connector will be vibrated with the cable. A severe vibration of the electrical male connector may cause a contact error or damage to the electrical female connector. Further, when the cable is frequently stretched, the electrical male connector may be kept connected to the electrical female connector by the lock means, however the electrical contacts between the cable and contact pins of the electrical male connector may be damaged, losing the signal transmission function of the cable.

SUMMARY OF THE INVENTION

The present invention has been accomplished to provide a signal transmission device for towing vehicle that eliminates the aforesaid problems. It is therefore one objective of the present invention to provide a signal transmission device for towing vehicle, which is easy to install and assures positive signal transmission during movement of the towing vehicle.

To achieve this objective of the present invention, the signal transmission device is designed for connection between two electrical connectors, for example a first electrical connector disposed at a truck-tractor of a towing vehicle and a second electrical connector disposed at a trailer of the towing vehicle. The signal transmission device comprises two magnetic holders, namely a first magnetic holder adapted for attaching the truck-tractor and a second magnetic holder adapted for attaching the trailer, two electrical connectors, namely third and fourth electrical connectors mounted to the first and second magnetic holders respectively, a stretchable coil tube, and a cable. The third electrical connector is adapted for connecting the first electrical connector at the truck-tractor and the fourth electrical connector is adapted for connecting the second electrical connector at the trailer. The cable is spirally inserted through the stretchable coil tube and provided with two ends electrically connected with the third and fourth electrical connectors.

According to the present invention, the third and fourth electrical connectors are mounted to the magnetic holders respectively. By means of fastening the magnetic holders to the truck-tractor and the trailer, the third and fourth electrical connectors are effectively installed on the truck-tractor and the trailer. Therefore, mounting and dismounting of the third and fourth electrical connectors are simple. Simply by means of attaching the magnetic holders to the truck-tractor and the trailer or directly pulling the magnetic holders away from the truck-tractor and the trailer, the mounting or dismounting of the third and fourth electrical connectors is done.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
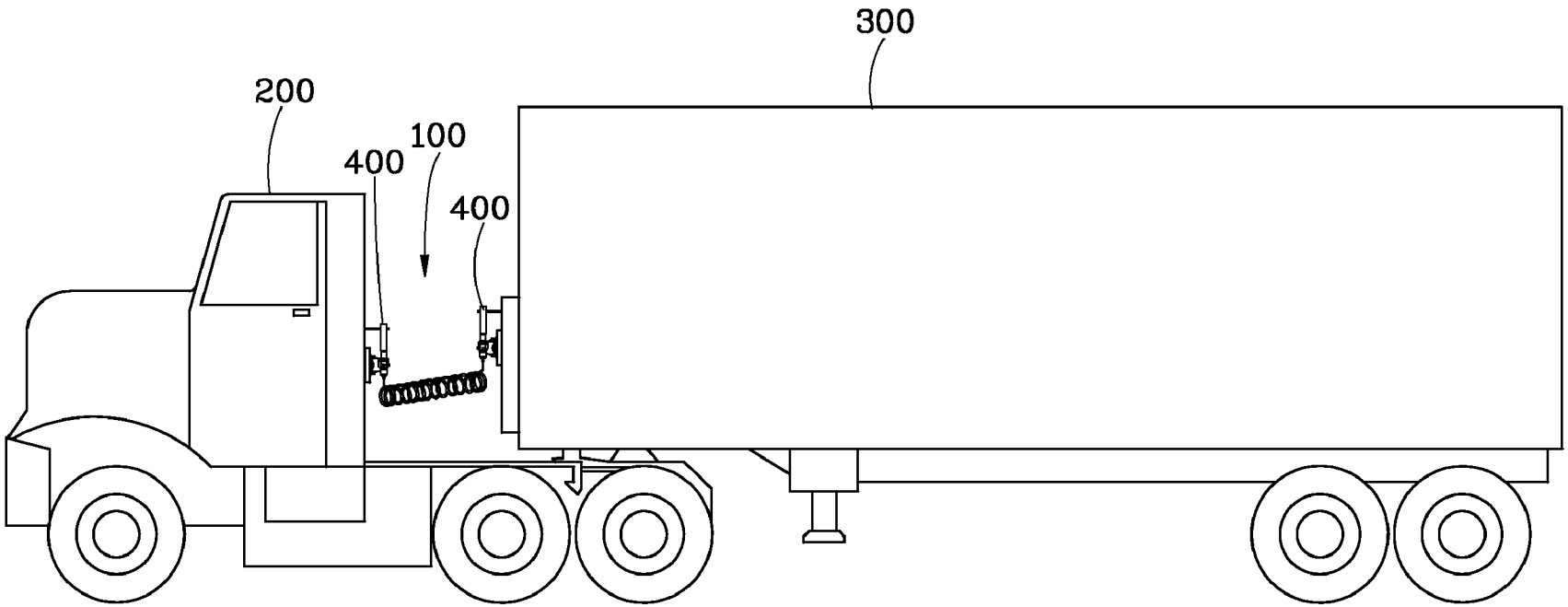
FIG. 1 is a schematic drawing showing a signal transmission device installed in a towing vehicle according to the present invention.

Referring to FIG. 1, a signal transmission device 100 is shown for use in a towing vehicle, including but not limited to tow truck, wrecker, breakdown truck, or breakdown lorry, and connected between an electric circuit system in a truck-tractor 200 and an electric circuit system in a trailer 300, including but not limited to semitrailer, van, or platform.

Figure 2:
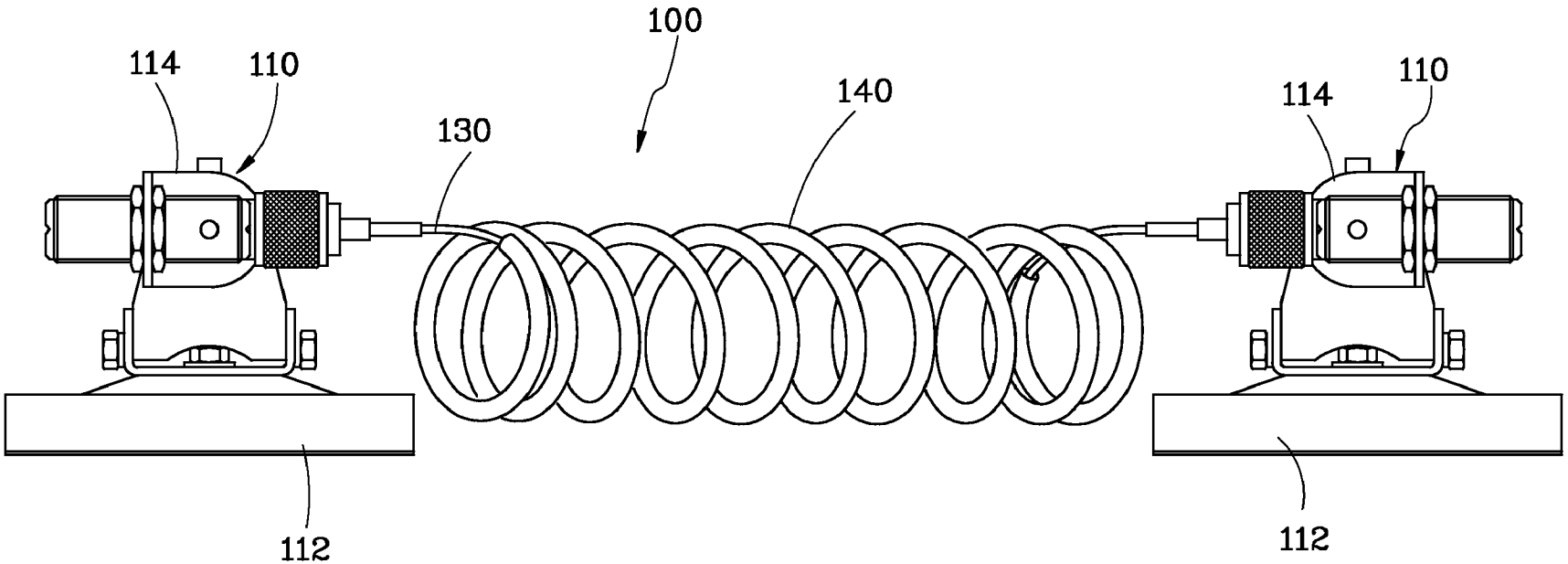
FIG. 2 is a side view of the signal transmission device according to the present invention.
Figure 3:
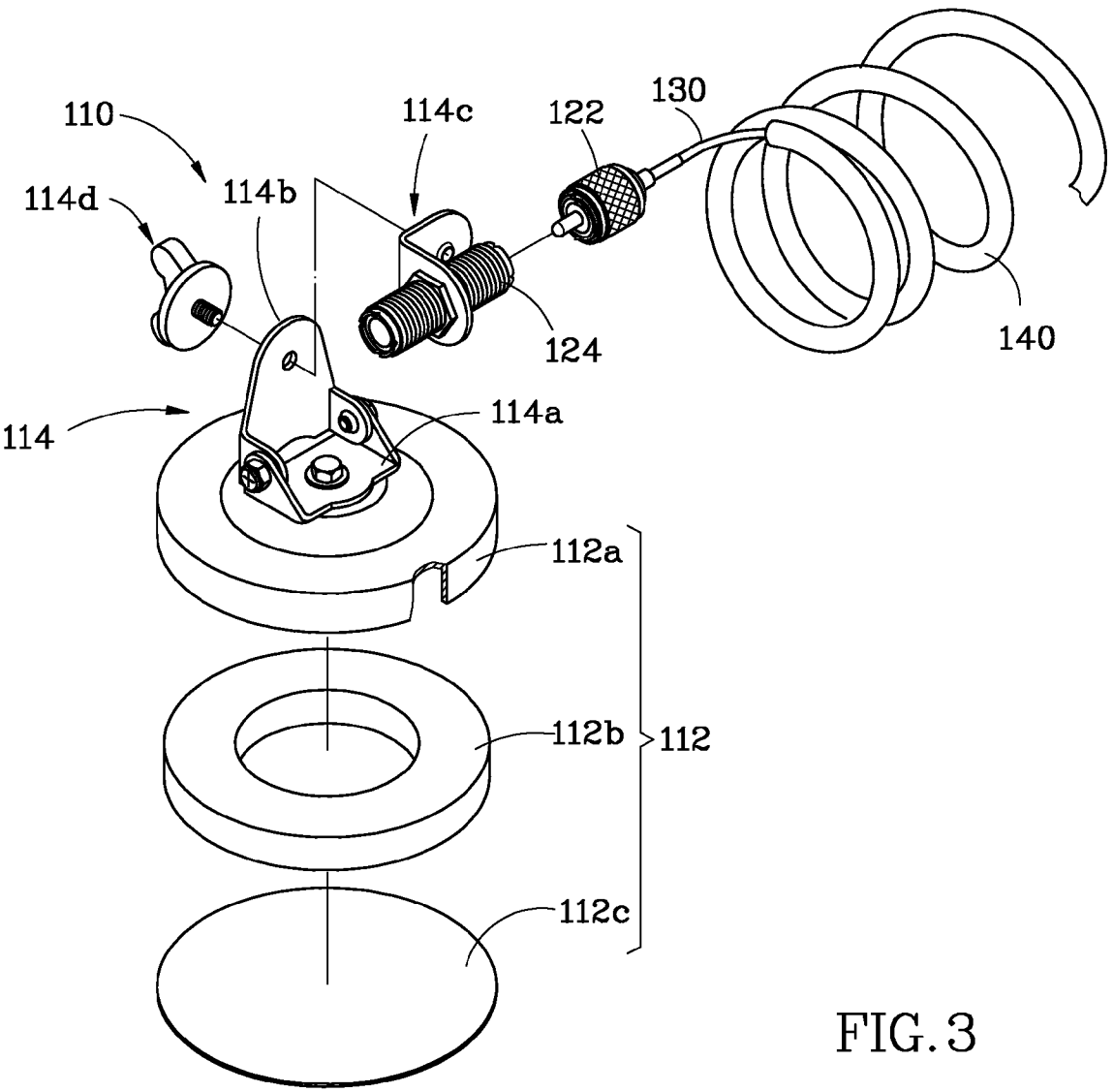
FIG. 3 is an exploded view of a part of the signal transmission device according to the present invention.

Referring to FIGS. 2 and 3, the signal transmission device 100 comprises two magnetic holders 110, two electrical connectors 120, a cable 130, and a stretchable coil tube 140.

Each magnetic holder 110 includes a magnetic base 112 and a bracket 114. The magnetic base 112 is to be fastened to the truck-tractor 200 or trailer 300 by means of a magnetic attractive force, comprising a cover 112*a*, a magnet 112*b* and a pad 112*c*. The cover 112*a* can be made of metal or high-strength plastics to provide a structural support. The cover 112*a* houses the magnet 112*b*, and allows the bracket 114 to be mounted thereon. The magnet 112*b* can be shaped like a circular or annular plate that fits the internal space of the cover 112*a*. After insertion of the magnet 112*b* into the inside of the cover 112*a*, the magnet 112*b* is secured to the inside of the cover 112*a* in a tight-fit relationship for fastening to truck-tractor 200 or trailer 300 by means of a magnetic attractive force. The pad 112*c* is arranged at one side of the cover 112*a* to cover the opening of the cover 112*a*.

Referring to FIGS. 2 and 3 again, the bracket 114 is provided on the outside of the associated cover 112*a* to hold one electrical connector 120. The bracket 114 is adapted for movably connecting the associated electrical connector 120 to the magnetic base 112 of the respective magnetic holder 110 so that the electrical connector 120 is movable relative to the magnetic base 112 in at least one degree of freedom. The bracket 114 comprises multiple connection members pivoted to one another, and therefore the bracket 114 is movable along or turnable about different axes. At least one of the connection members is pivoted or affixed to the cover 112*a* of the magnetic base 112. The electrical connector 120 is mounted to another connection member of the bracket 114.

Referring to FIG. 3 again, the connection members of the bracket 114 include a first connection member 114*a*, a second connection member 114*b* and a third connection member 114*c*. The first connection member 114*a* has a bottom wall and two lugs upwardly extending from the bottom wall at two sides. The bottom wall is pivotally connected to the center of the top wall of the cover 112*a* with a screw bolt so that the first connection member 114*a* is pivotable relative to the cover 112*a* and rotatable about the central axis of the screw bolt. The second connection member 114*b* has a side panel and two connection panels. The two connection panels are respectively pivoted to the two lugs of the first connection member 114*a* so that the second connection member 114*b* is pivoted to the first connection member 114*a* and biasable relative to the first connection member 114*a*. The third connection member 114*c* is an angle plate, having a mounting end and a bearing end. The mounting end is pivoted to the side panel of the second connection member. The bearing end has a through hole for the insertion of the associated electrical connector 120 for enabling the associated electrical connector 120 to be installed in the third connection member 114*c*. To facilitate turning of the third connection member 114*c*, a screw, for example, hand screw 114*d* is inserted through the side panel of the second connection member 114*b* and threaded into the mounting end of the third connection member 114*c*. The screw 114*d* is rotatable by an operator between a locking position and an unlocking position so that the third connection member 114*c* can be locked, or unlocked for allowing adjustment of the angle of the associated electrical connector 120.

Referring to FIGS. 2 and 3 again, the electrical connectors 120 are respectively mounted in the brackets 114 of the magnetic holders 110, and respectively secured to the surfaces of the truck-tractor 200 and the surface of the trailer 300 by the associated magnetic holders 110 by means of a magnetic attractive force. Further, the bracket 114 of each magnetic holder 110 allows displacement or rotation of the associated electrical connector 120 in at least one degree of freedom. The electrical connectors 120 are respectively and electrically connected to a respective electrical connector 400 disposed at surfaces of the truck-tractor 200 and the trailer 300, and the two opposite ends of the cable 130 are respectively connected to the two electrical connectors 120, and therefore the cable 130 electrically connects the electric circuit system of the truck-tractor 200 and the electric circuit system of the trailer 300 together. The type of the electrical connectors 120 is determined subject to the type of the electrical connectors 400. For example, the electrical connectors 120 can be male connector type electrical connectors to match with the female connector type electrical connectors 400. Alternatively, electrical connectors 120 can be female connector type electrical connectors to match with the male connector type electrical connectors 400. According to the present preferred embodiment, each electrical connector 120 is comprised of a connecting head 122 and an adapter 124. The cable 130 has two ends thereof connected to the connecting heads 122 of the electrical connectors 120. The adapter 124 has one end fitting the connecting head 122 so that the connecting head 122 is connectable to the adapter 124. The other end of the adapter 124 fits the associated electrical connector 400 so that the adapter 124 is connectable to the associated electrical connector 400. By means of changing the adapter 124, the electrical connector 120 can be connected to a different type of electrical connector 400.

Referring to FIGS. 2 and 3 again, the specifications of the cable 130 and the electrical connectors 120 are determined subject to the signal to be transmitted. The cable 130 can be a conductive single wire or twisted pair surrounded by an insulation layer for transmitting a single electric signal. Alternatively, the cable 130 can be comprised of multiple conductive wires or twisted pairs surrounded with multiple insulation layers for transmitting multiple electric signals. The stretchable coil tube 140 is stretchable along the longitudinal axis to extend the length, and will return to its former length subject to its elastic power when the external stretch force disappears. The cable 130 is inserted through the stretchable coil tube 140, and therefore the cable 130 is kept in the shape of a spiral coil and can be stretched to extend in length and can return to its former length when the external stretch force disappears.

Figure 4:
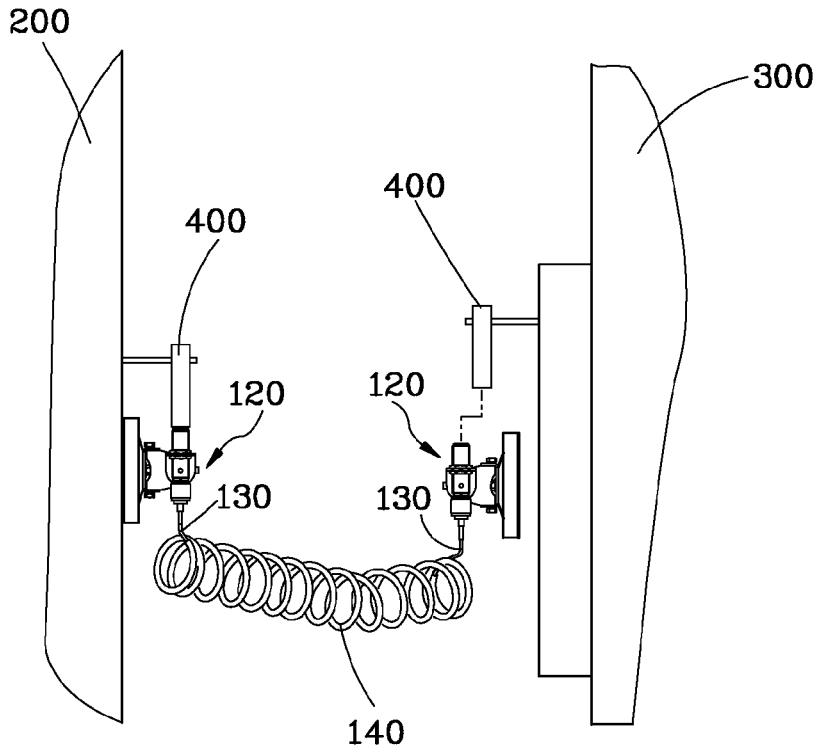
FIG. 4 is a schematic side view of the signal transmission device, showing the arrangement of the signal transmission device between the truck-tractor and the trailer.

Referring to FIG. 4, the magnetic bases 112 of the magnetic holders 110 are respectively fastened to a ferromagnetic part of the truck-tractor 200 and a ferromagnetic part of the trailer 300, for example, the ferrous skin of the truck-tractor 200 and the chassis of the trailer 300 by means of a magnetic attractive force. The magnetic holders 110 are respectively attached to the truck-tractor 200 and the trailer 300 with the side of the respective pad 112*c*, prohibiting wearing of the surfaces of the truck-tractor 200 and the trailer 300 by the respective magnetic bases 112. During installation, the magnetic base 112 of each magnetic holder 110 is attached to the truck-tractor 200 or trailer 300 near the associated electrical connector 400, and then the bracket 114 is adjusted to adjust the angle and direction of the associated electrical connector 120, and then the position of the magnetic base 112 is adjusted to have the associated electrical connector 120 be connected to the matching electrical connector 400.

In the aforesaid application, the cable 130 is inserted through the stretchable coil tube 140, and therefore the cable 130 is kept in the shape of a spiral coil. When the two opposite ends of the cable 130 are stretched, for example, when the truck-tractor 200 is turning to extend the distance between the two opposite ends of the cable 130, the cable 130 and the stretchable coil tube 140 are gradually stretched in length. When the external stretch force disappears, the stretchable coil tube 140 will return to its former shape to return the cable 130 to the spiral coil shape, shortening the length. Therefore, when the distance between the two opposite ends of the cable 130 is increased (i.e., the distance between the two electrical connector 120 is increased), the cable 130 is elastically deformed to extend in length. On the contrary, when the distance between the two opposite ends of the cable 130 is reduced (i.e., the distance between the two electrical connector 120 is reduced), the length of the cable 130 is shortened, avoiding hanging down of the middle part of the cable 130 to cause excessive oscillation of the cable 130 or hooking of the cable 130 by an external body.

Except the binding force produced from the connection between the electrical connector 120 and the matched electrical cable 400, the magnetic holder 110 also holds the associated electrical connector 120 in place. Therefore, the stretching force produced from the cable 130 during oscillation of the cable 130 and movement of the towing vehicle does not cause displacement of the electrical connectors 120. This feature simplifies the arrangement of the electrical connectors 400. Therefore, it is not necessary to install lock means in the electrical connectors 400 and the electrical connectors 120 as the prior art designs. Further, the installation of the magnetic holders 110 is simple. Simply by attaching the magnetic holder 110 to the truck-tractor 200 or trailer 300, the magnetic base 112 is directly fastened to the truck-tractor 200 or trailer 300 by means of a magnetic attractive force.

When changing the trailer 300 of the towing vehicle, the worker can directly pull the magnetic holders 110 to separate the magnetic base 112 from the truck-tractor 200 or trailer 300, disconnecting the associated electrical connector 120 from the matched electrical connector 400. Therefore, mounting and dismounting of the magnetic holders 110 and the electrical connectors 120 can be achieved simply by means of the simple action of pulling or attaching without the use of any complicated lock means or any complicated lock means operation procedure.

In actual application, one end of the cable 130 is electrically connected to the console in the drivers' room of the truck-tractor 200 through one electrical connector 120 and the matched electrical connector 400, and the other end of the cable 130 is connected to the circuit system of the trailer 300. The circuit system of the trailer 300 can be regular passive safety parts, such as stoplights, directional lights, parking lights, and etc. When the driver of the truck-tractor 200 switches on the switches in the console, the electric control signals are transmitted through the cable 130 to turn on the stoplights, directional lights, parking lights, and etc. Further, the circuit system of the trailer 300 can be an active detection system that transmits the detected data by means of an electric signal through the cable 130 to the console in the truck-tractor 200. For example, the circuit system of the trailer 300 can be a TMPS (Tire Pressure Monitoring System). The tire pressure sensors that are installed in the wheels of trailer 300 transmit the respective detected tire pressure signal to the receiver in the trailer 300 by radio. After processed through a filtering and amplification process, the tire pressure signal is transmitted through the cable 130 to the console in the truck-tractor 200.

Figure 5:
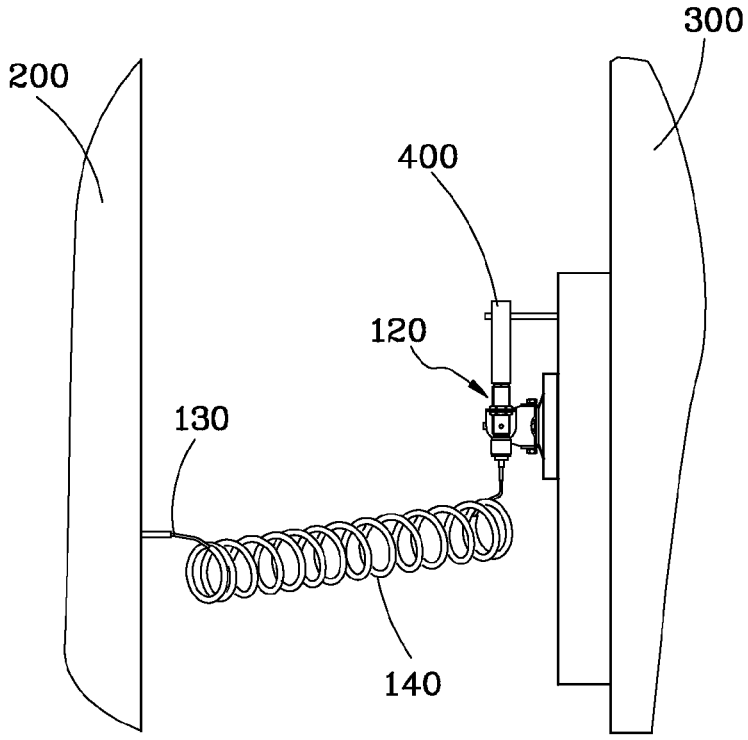
FIG. 5 is a schematic drawing showing an alternate form of the signal transmission device of the present invention.

Referring to FIG. 5, under most conditions, changing the trailer from the truck-tractor needs not to simultaneously detach the two ends of the cable, and detaching one end of the cable is enough for allowing exchange of different trailers. Therefore, it is not imperative to have the two opposite ends of the cable be provided with a respective electrical connector, i.e., one end of the cable is provided with an electrical connector and the other end of the cable is directly connected to the circuit system of the towing vehicle. According to the embodiment shown in FIG. 5, the cable 130 is directly extending from the circuit system of the truck-tractor 200, and the other end of the cable 130 is provided with an electrical connector 120 for connection to the matched electrical connector 400 at the trailer 300.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A signal transmission device for connection between a first electrical connector disposed at a truck-tractor of a towing vehicle and a second electrical connector disposed at a trailer of the towing vehicle for transmission of electric signals, the signal transmission device comprising:

first and second magnetic holders for attaching the truck-tractor and the trailer respectively;

a third electrical connector mounted to the first magnetic holder for connecting the first electrical connector;

a fourth electrical connector mounted to the second magnetic holder for connecting the second electrical connector;

a stretchable coil tube; and a cable spirally inserted through the stretchable coil tube and provided with two ends electrically connected with the third and fourth electrical connectors respectively, wherein each of the magnetic holders comprises a magnetic base for attaching one of the truck-tractor and the trailer of the towing vehicle, and a bracket mounted on the magnetic base to support one of the third and fourth electrical connectors, wherein the bracket comprises a plurality of connection members pivoted to one another; at least one of the members is pivoted or fastened to the magnetic base and another one of the connection members holds one of the third and fourth electrical connectors.

2. The signal transmission device as claimed in claim 1, wherein the magnetic base comprises a cover that supports the bracket and a magnet mounted inside the cover.

3. The signal transmission device as claimed in claim 2, wherein the magnetic base further comprises a pad covered on one side of the cover.

4. The signal transmission device as claimed in claim 1, wherein the connection members include:

a first connection member pivoted to the magnetic base;

a second connection member pivoted to the first connection member; and a third connection member pivoted to the second connection member and holding one of the third and fourth electrical connectors.

5. The signal transmission device as claimed in claim 1, wherein each of the third and fourth electrical connectors is a male electrical connector.

6. The signal transmission device as claimed in claim 1, wherein each of the third and fourth electrical connectors is a female electrical connector.

7. A signal transmission device for connection between a first electrical connector disposed at a truck-tractor of a towing vehicle and a second electrical connector disposed at a trailer of the towing vehicle for transmission of electric signals, the signal transmission device comprising:

first and second magnetic holders for attaching the truck-tractor and the trailer respectively;

a third electrical connector mounted to the first magnetic holder for connecting the first electrical connector;

a fourth electrical connector mounted to the second magnetic holder for connecting the second electrical connector;

a stretchable coil tube; and a cable spirally inserted through the stretchable coil tube and provided with two ends electrically connected with the third and fourth electrical connectors respectively, wherein each of the third and fourth electrical connectors comprises a connecting head connected to one of the two ends of the cable, and an adapter having an end connected to the connecting head, and an opposite end for connecting one of the first and second electrical connectors.

8. A signal transmission device for use in a towing vehicle, comprising:

a magnetic holder;

an electrical connector mounted to the magnetic holder;

a stretchable coil tube; and a cable spirally inserted through the stretchable coil tube and provided with an end electrically connected with the electrical connector, wherein the magnetic holder comprises magnetic base and a bracket mounted on the magnetic base to support the electrical connector, wherein the bracket comprises a plurality of connection members pivoted to one another; at least one of the connection members is pivoted or fastened to the magnetic base and another one of the connection members holds the electrical connector.

9. The signal transmission device as claimed in claim 8, wherein the magnetic base comprises a cover that supports the bracket and a magnet mounted inside the cover.

10. The signal transmission device as claimed in claim 9, wherein the magnetic base further comprises a pad covered on one side of the cover.

11. The signal transmission device as claimed in claim 8, wherein the connection members include:

a first connection member pivoted to the magnetic base;

a second connection member pivoted to the first connection member; and a third connection member pivoted to the second connection member and holding the electrical connector.

12. The signal transmission device as claimed in claim 8, wherein the electrical connector is a male electrical connector.

13. The signal transmission device as claimed in claim 8, wherein the electrical connector is a female electrical connector.

14. A signal transmission device for use in a towing vehicle, comprising:

a magnetic holder;

an electrical connector mounted to the magnetic holder;

a stretchable coil tube; and a cable spirally inserted through the stretchable coil tube and provided with an end electrically connected with the electrical connecter, wherein the electrical connector comprises a connecting head connected to the end of the cable, and an adapter having an end connected to the connecting head, and an opposite end adapted for connecting an external electrical connector.

* * * * *